US005517699A

United States Patent [19]

Abraham, II

[11] Patent Number: 5,517,699

[45] Date of Patent: May 21, 1996

[54] DEVICES FOR PREVENTING CERVICAL SPINE INJURIES IN CONTACT SPORTS

[76] Inventor: George E. Abraham, II, 338 Claremont Cir., Vicksburg, Miss. 39180

[21] Appl. No.: 458,773

[22] Filed: Jun. 2, 1995

Related U.S. Application Data

[63] Continuation-in-part of Ser. No. 120,485, Sep. 14, 1993, abandoned.

[51] Int. Cl.[6] ..... A63B 71/10

[52] U.S. Cl. ..... 2/425; 2/2; 2/205

[58] Field of Search ..... 2/205, 3 R, 421, 2/425, 415, 416, 419, 422, 2; 602/5, 12, 16, 17, 18, 19; 128/857, 869

[56] References Cited

U.S. PATENT DOCUMENTS

| | | |
|---|---|---|
| 1,409,326 | 3/1922 | Williamson . |
| 3,041,623 | 7/1962 | Glahe . |
| 3,134,106 | 5/1964 | Shaffer . |
| 3,148,375 | 9/1964 | Jones . |
| 3,242,500 | 3/1966 | Derr . |
| 3,258,010 | 6/1966 | Austin et al. . |
| 3,671,974 | 6/1972 | Sims . |
| 3,818,509 | 6/1974 | Romo et al. . |
| 3,873,996 | 4/1975 | Varteressian . |
| 3,889,668 | 6/1975 | Ochs et al. . |
| 4,020,507 | 5/1977 | Morton . |
| 4,219,193 | 8/1980 | Newman . |
| 4,501,023 | 2/1985 | Bilberry . |
| 4,825,476 | 5/1989 | Andrews . |
| 5,027,833 | 7/1991 | Calkin . |
| 5,123,408 | 6/1992 | Gaines . |
| 5,261,125 | 11/1993 | Cartwright . |
| 5,287,562 | 2/1994 | Rush, III . |
| 5,313,670 | 5/1994 | Archer, III . |

*Primary Examiner*—C. D. Crowder
*Assistant Examiner*—Larry D. Worrell, Jr.
*Attorney, Agent, or Firm*—Nixon & Vanderhye

[57] ABSTRACT

Helmet accessory devices are provided for protecting a wearer from cervical spine injuries. The devices comprise a shoulder assembly (401, 501) to which at least one leaf spring (408, 508) has its first end (404, 504) rigidly connected. A post (406, 506) is formed on the leaf spring to carry a hood (410) superposed above a helmet (430) worn by the wearer. Axially compressive forces sustained by the hood (410) are opposed by the post (408, 508) and the shoulder assembly (401, 501).

34 Claims, 7 Drawing Sheets

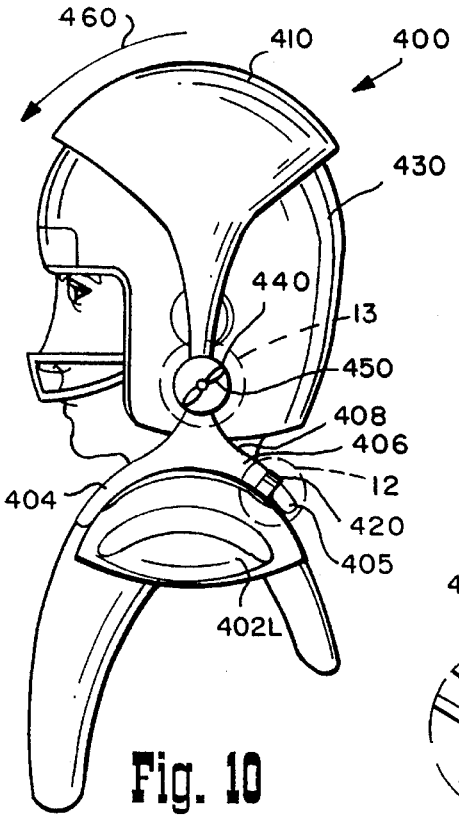
Fig. 10
Fig. 13
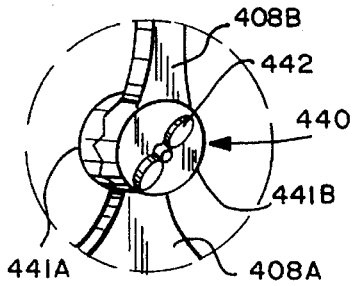
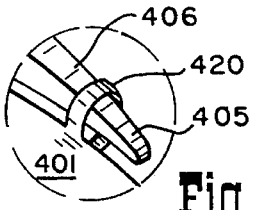
Fig. 12
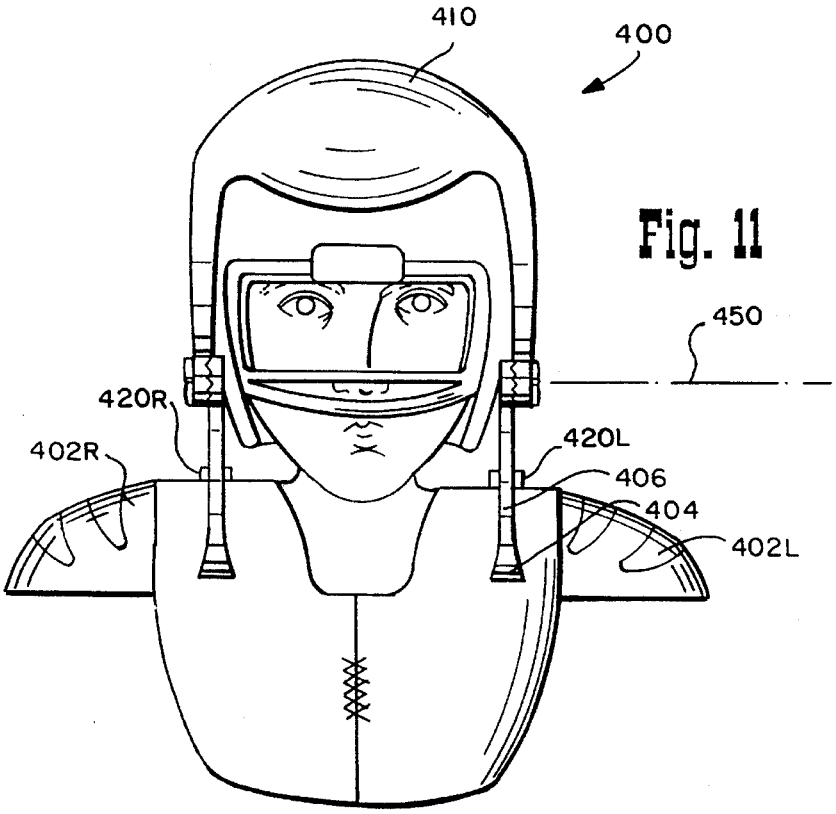
Fig. 11

DEVICES FOR PREVENTING CERVICAL SPINE INJURIES IN CONTACT SPORTS

BACKGROUND

This application is a continuation-in-part of U.S. patent application Ser. No. 08/120,485, filed Sep. 14, 1993, now abandoned, which is incorporated herein by reference.

1. Field of Invention

This invention pertains to prevention of traumatic injury of the cervical spine in contact sports.

2. Related Art and Other Considerations

Injuries of the cervical spine are among the most catastrophic of sports injuries. Depending upon the severity of the injury, some degree of permanent neurological dysfunction (such as paralysis) almost always results. The medical, psychological, social, and economic consequences of these injuries is devastating. Moreover, there is no curative treatment available at present.

Prevention of cervical spine injuries is of paramount importance. However, other than specific coaching techniques, such as proper posture for blocking and tackling, no reliable method of prevention is presently utilized. Unfortunately, in the zeal of competition, spontaneous reflex often overcomes learned techniques, leading to significant risk of injury.

Cervical vertebral fractures are caused by axial loading of force to a cervical spine which has been flexed anteriorly about thirty degrees. Injury can occur in as little as 8.4 milliseconds.

Axial compression (or loading) of the cervical spine has been shown to be the primary mechanism of severe cervical spine injuries in football. The axis of the spine refers to the alignment of the vertebrae in the superior/inferior direction (e.g., the vertical direction).

A typical scenario for a football injury is as follows. A player flexes his neck to ram an opponent, straightening his cervical spine. Upon collision with the opponent, the head stops while the body keeps moving forward per Newton's first law of motion. The cervical spine is compressed between the head and the body by an axial force. This force causes compressive deformation of the intervertebral discs; flexing and buckling of the spine; and resulting fracture, subluxation (partial dislocation), or dislocation of vertebra(e). The spinal cord, which is contiguous with the vertebral column, is usually severely and irreversibly injured as a consequence.

Accordingly, it is an object of the present invention to provide a device which prevents traumatic injury of the cervical spine in contact sports.

SUMMARY

Helmet accessory devices are provided for protecting a wearer from cervical spine injuries. A first device comprises a helmet having a circumferential exterior portion with a flange provided posteriorly thereon. A helmet support ring is in encircling and rotating contact with at least a portion of a circumferential exterior portion of the helmet, so that the flange on the helmet engages the helmet support ring to prevent anterior flexion. A frame mounts the helmet support ring on two shoulders of its wearer so that force experienced by the helmet is transmitted by the frame to the two shoulders. The helmet support ring has a bearing surface oriented for contact with the circumferential portion of the helmet.

A second device comprises a strut having a first end configured for attachment to a faceguard of a helmet. A second end of the strut is attached to a base pad. The base bears against a chest of the wearer to prevent an undesired degree of anterior flexion. The strut has a length chosen to prevent an undesired degree of anterior flexion. The strut comprises an inverted V-shaped member having two legs at the second end thereof for attachment to the base.

A third device comprises a hood held aloft just above a helmet by two post members, the post members in turn being mounted in spaced-apart relation on respective shoulder-borne base members. An underside surface of the hood has a curvature substantially similar to a curvature of a helmet worn by the wearer. The two post members hold the underside surface of the hood aloft above the helmet by a predetermined distance. At one end the base members are hingedly attached to shoulder pads worn by the wearer. At another end the base members are releasably attached to shoulder pads worn by the wearer.

Devices of the fourth and fifth embodiments comprise a shoulder assembly to which at least one leaf spring has its first end rigidly connected. A post is formed on the leaf spring to carry a hood superposed above a helmet worn by the wearer. Axially compressive forces sustained by the hood are opposed by the post and the shoulder assembly.

In the fourth embodiment device, the leaf spring has a cantilevered second end. A spring limiting member is mounted on the shoulder assembly for limiting an extent of movement of the leaf spring, particularly the second end of the leaf spring. The spring limiting member comprises an inverted U-shaped bracket mounted on the shoulder assembly. The post is formed on a portion of the leaf spring intermediate its first and second ends.

In a fifth embodiment device, the post is coterminous with a second end of the leaf spring and orthogonal thereto. The leaf spring is mounted on the shoulder assembly to be essentially parallel to a wearer's clavicle.

In both fourth and fifth embodiments a locking member is provided on the post to facilitate selectively rotation of the hood about a horizontal axis when the locking member is unlocked for permitting the wearer to remove the helmet.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 10 is a right side view of a cervical spine injury prevention device in a protective orientation according to a fourth embodiment of the invention.

FIG. 11 is a front view of the device of FIG. 10.

FIG. 12 is an enlarged view of a spring limiting member of the device of FIG. 10.

FIG. 13 is an enlarged view of a locking member of the device of FIG. 10.

DETAILED DESCRIPTION OF THE DRAWINGS

Figure 1:
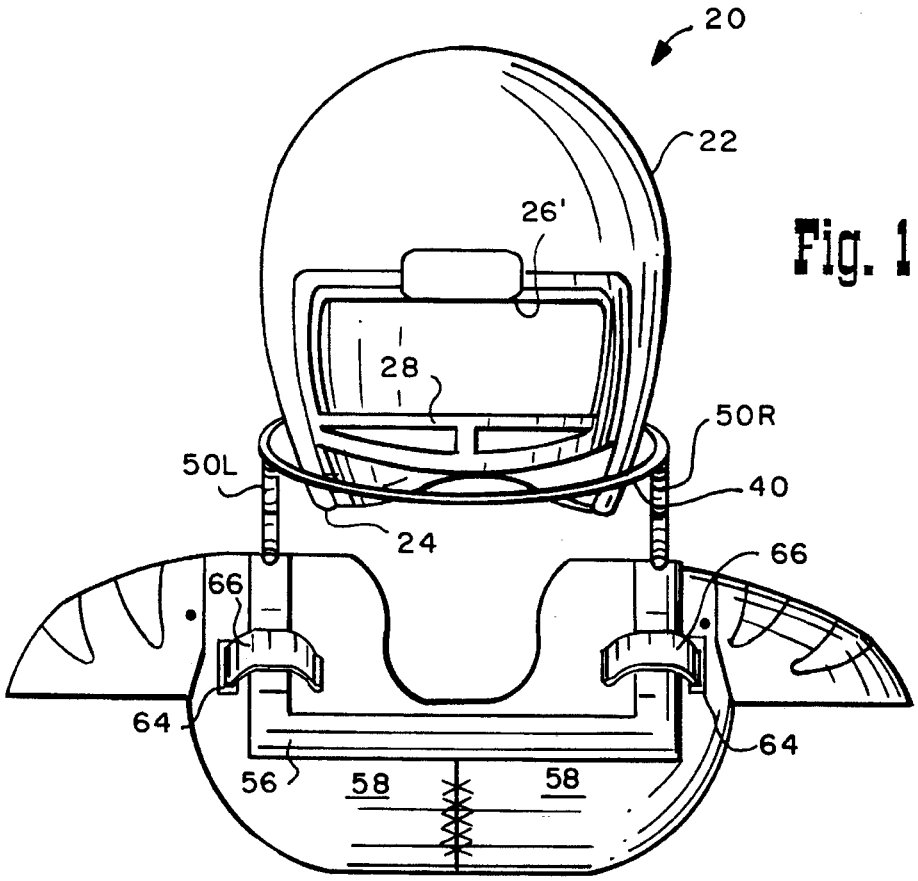
FIG. 1 is a front view of a cervical spine injury prevention device according to a first embodiment of the invention.
Figure 2:
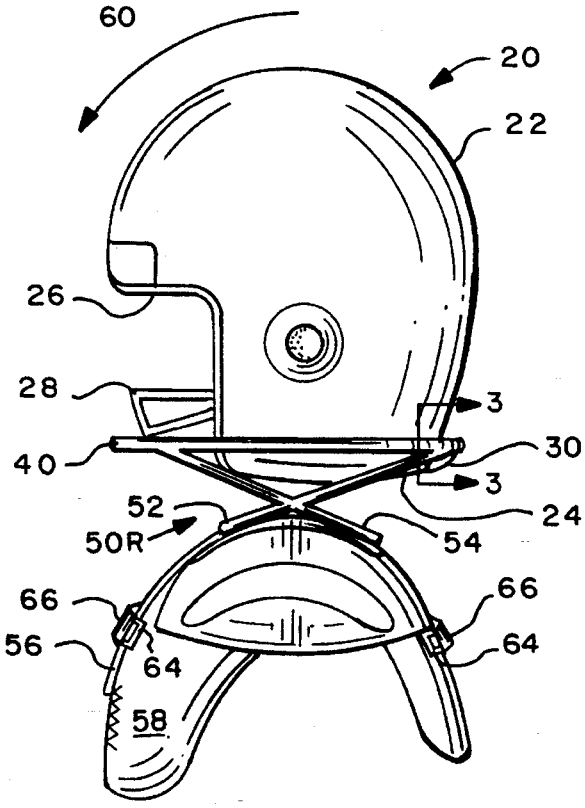
FIG. 2 is a side view of the device of FIG. 1.

In illustrating a first device for preventing cervical spine injuries, FIG. 1 and FIG. 2 show a helmet 20 for a contact sport, such as football, for example. Helmet 20 has a hard exterior circumferential shell 22 which has a neck opening 24 and a face opening 26. A faceguard 28 is attached to shell 22 in usual manner for protectively bridging the face opening 26. Helmet 20 of FIG. 1 has a posterior flange 30 mounted, molded, or otherwise formed thereon (see FIG. 2). Flange 30 extends circumferentially around a portion of the back of shell 22.

In addition to flange 30, the injury prevention device of the embodiment of FIGS. 1 and 2 includes a helmet support ring 40 which encircles helmet shell 22 at a position below faceguard 28. With reference to a standing, forward-looking wearer, helmet support ring 40 lies in a horizontal plane. As explained hereinafter, helmet support ring 40 is in rotating contact with at least a portion of shell 22. The portion of shell 22 contacted by ring 40 is preferably spherical. In addition, helmet 20 differs from conventional helmets in that the attaching locations of accessories (e.g., chin straps) are slightly displaced.

Helmet support ring 40 is held aloft and in rotating contact with helmet shell 22 by frame 50, including left and right frame strut assemblies 50L and 50R, respectively (seen in FIG. 1 looking face-on to the wearer). Frame strut assemblies 50L and 50R are essentially mirror images of one another. Frame assembly 50 comprises two coplanar frame struts 52, 54 which form an "X" shape in a vertical plane (again with reference to a standing, forward-looking wearer). The bases of each strut 52, 54 are mounted on shoulder plate 56 (see FIG. 4). Shoulder plate 56 is, in turn, mounted on shoulder pads 58 (modified to receive plate 56). Upper ends of struts 52, 54 are welded, integral, or otherwise secured to helmet support ring 40.

Figure 4A:
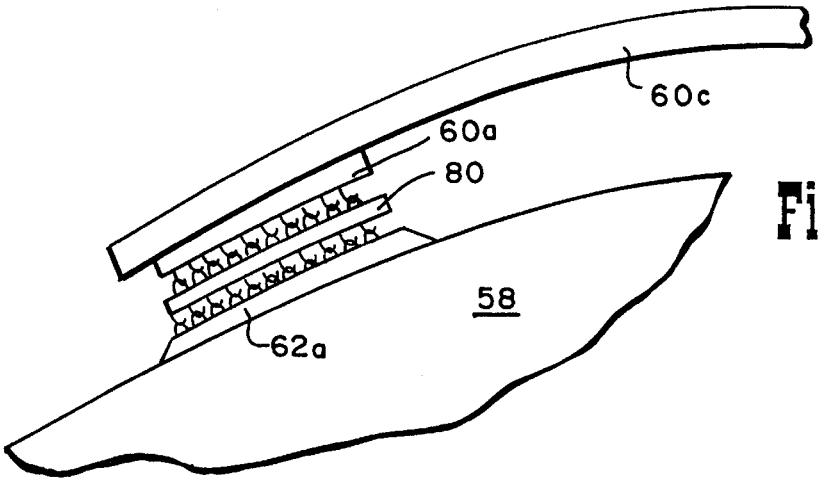
FIG. 4A is a side view of a portion of a spacer insert selective positionable between a shoulder plate of the device of FIG. 1 and shoulder pads.
Figure 4:
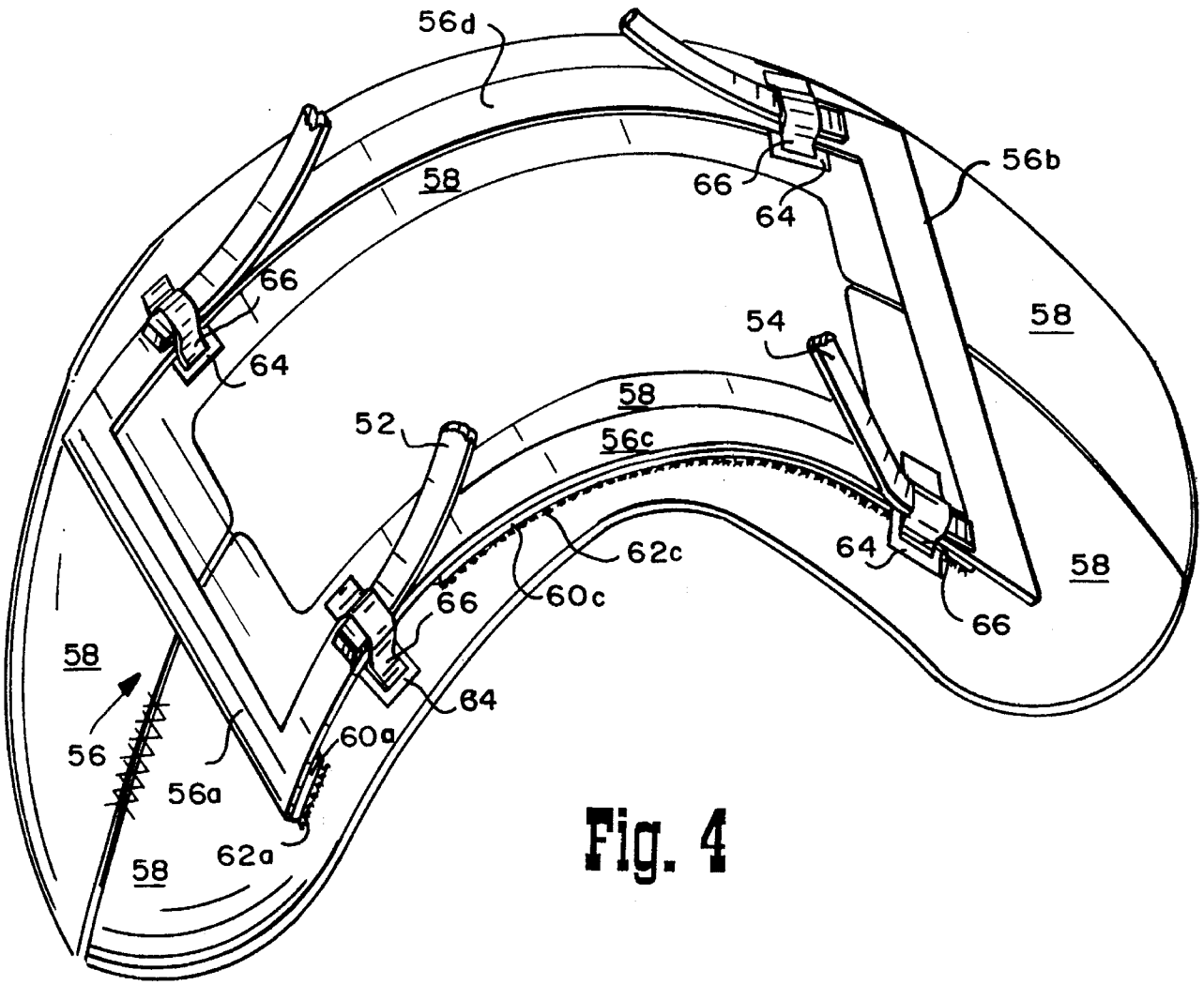
FIG. 4 is a side isometric view, partially broken, showing a shoulder plate of the device of FIG. 1 and its mounting on shoulder pads.

As shown in FIG. 4, shoulder plate 56 comprises four members including front member **56*a*, rear member 56*b*, right member 56*c*, and left member 56*d*. Member 56*a* is shaped to lie over the chest of a wearer, while member 56*b* is shaped to lie over a back of the wearer. Members 56*c* and 56*d* have an quasi-arcuate shape for extending over the shoulders of the wearer. If projected on an imaginary horizontal plane, shoulder plate 56 would have an essentially quadrilateral shape, forming both an external perimeter and an internal perimeter enclosing the neck of the wearer. In the illustrated embodiment, shoulder plate 56** is formed from a hard plastic.

At various locations, shoulder plate 56 has fasteners, such as hook and eye fastener patches 60 formed on an underside thereof. FIG. 4 particularly illustrates fastener patch **60*a* formed on a length of an underside of shoulder plate member 56*a*, and fastener patch 60*c* formed along a length of an underside of shoulder plate member 56*c*. Although unillustrated, similar fastener patches are formed under shoulder plate members 56*b* and 56*d***.

Shoulder pads 58 likewise have mating fastener patches 62 provided thereon in locations for engaging corresponding fastener patches 60. Thus, fastener patches 62 can likewise be hook and eye type fasteners, for example. FIG. 4 illustrates mating shoulder pad-borne fastener patches **62*a*, 62*c* for engaging corresponding fastener patches 60*a*, 60*c***, respectively.

In the embodiment illustrated in FIG. 4, shoulder pads 58 also bear, on their upper surfaces, frame-holding fastener patches 64. Fastener patches 64 are positioned to engage ends of frame strips 66. Frame strips 66 extend over shoulder plate 56 and a base of a strut 52, 54, to secure strut 52, 54 to shoulder plate 56 and to shoulder pads 58. Either or both ends of frame strips 66 may have a fastener (e.g., hook and eye) under surface for engaging its corresponding frame-holding fastener patch 64.

As an alternative to using frame strips 66 for mounting frame assembly 50 to shoulder plate 56, base ends of struts 52, 54 can be integrally formed to shoulder plate 56, or secured thereto by other fasteners.

Helmet support ring 40 is held aloft by frame assemblies 50L, 50R at a height just slightly above the vertical position of flange 30 (when the wearer is looking straight ahead, e.g., when the wearer's head is not inclined). Should the wearer receive a head blow which otherwise would cause the helmet to incline frontwardly (e.g., the direction shown by arrow 60 in FIG. 2) by a perilous amount (and accordingly the wearer's head sustain anterior flexion), flange 30 will catch support ring 40 whereby helmet 20 will be precluded from further motion.

Figure 3:
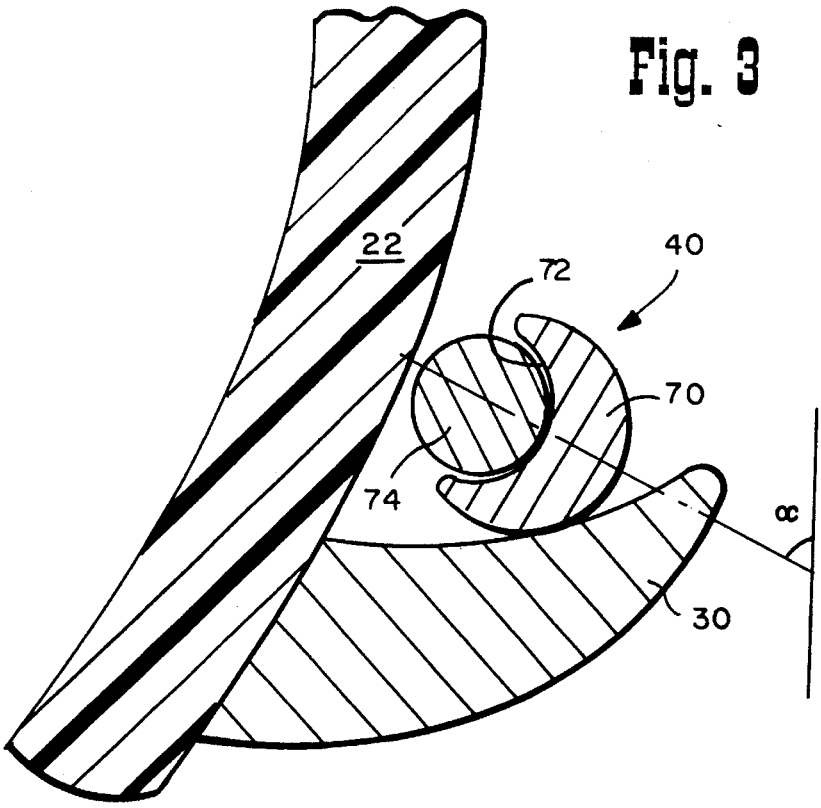
FIG. 3 is a sectional view taken along line 3—3 of FIG. 2.

Helmet support ring 40 snugly but rotatably encircles shell 22. As shown in FIG. 3, support ring 40 comprises a channel member 70 having a interior circumferential raceway 72 for accommodating bearings 74. Raceway 72 is formed so that bearings 74 are oriented upwardly (at angle alpha shown in FIG. 3) for rolling contact with shell 22. Thus, bearings 74 are exposed on an inner aspect of support ring 40. Bearings 74 support shell 22 and allow shell 22 to rotate (about a vertical axis) within helmet support ring 40.

Helmet support ring 40 and frame assemblies 50 are formed from materials having suitable tensile strength, such as (for example) steel or a steel re-inforced plastic.

FIG. 4A shows that the position or altitude of helmet support ring 40 can be changed by selective utilization of a spacer insert 80. Spacer insert 80 has dual opposing surfaces provided with fastener elements, in particular an undersurface which mates with fastener patch **62*a* and an upper surface which mates with fastener patch 60*a*. A number of spacer inserts 80 can be utilized to obtain optimum positioning of helmet support ring 40** for a particular wearer.

The device of FIG. 1 can be manufactured in various standard sizes for proper fit to individual wearers. Each wearer can be fitted to an appropriate sized device, depending upon relationships among the wearer's helmet, head and neck, and shoulder pads. Fine tuning of the fit can be achieved utilizing the inserts 80 described above with reference to FIG. 4A.

An advantage of the device of FIG. 1 is that helmet 20 does not rest on the wearer's head, but rather on the wearer's shoulders, allowing the device to transfer the energy of impact to the shoulders, not the cervical spine. Movement of helmet 20, rotationally and anterior/posterior flexion/extension, is accomplished by the chin strap and points of contact with the wearer's face (laterally) and neck (posteriorly).

Figure 5:
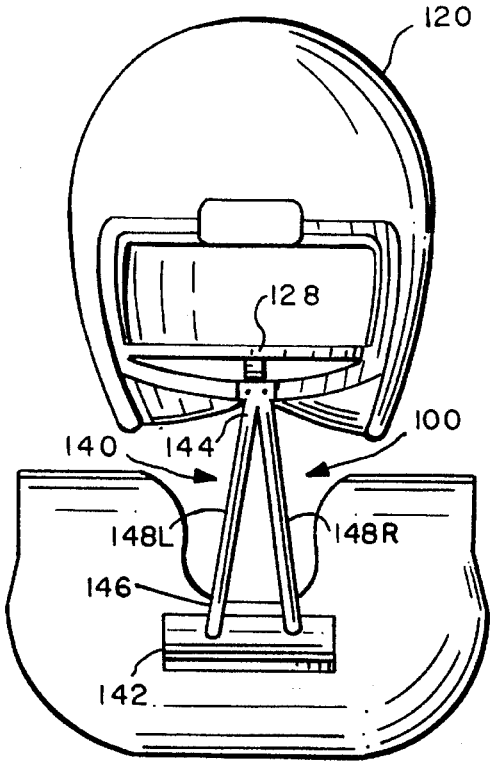
FIG. 5 is a front view of a cervical spine injury prevention device according to a second embodiment of the invention.
Figure 6:
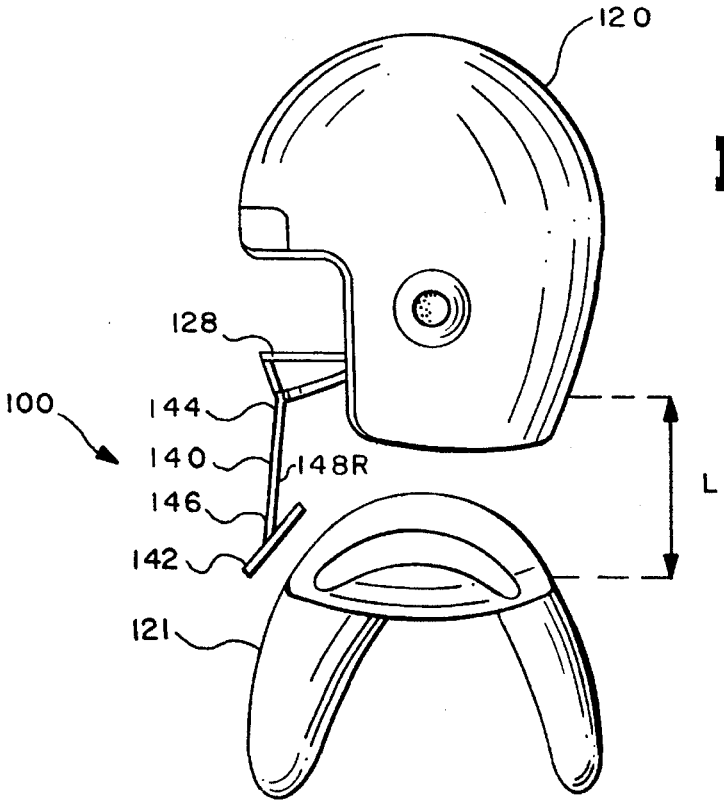
FIG. 6 is a side view of the device of FIG. 5.

FIG. 5 and FIG. 6 illustrate a second cervical spine injury device 100. In one embodiment, device 100 is utilized with a conventional helmet 120 and conventional shoulder pads 121. Helmet 120 has a conventional faceguard 128.

Injury prevention device 100 comprises a strut 140 and a base 142. Strut 140 has a first end or strut upper end 144 and a second end or strut lower end 146. In the illustrated embodiment, strut 140 has an essentially inverted V-shape and is comprises of strut legs 148L and 148R.

Strut upper end 144 is configured for attachment to faceguard 128. In particular, strut upper end 144 is attached to a center of a lower most member of faceguard 128. Strut upper end 144 can be formed integrally with faceguard 128. Other alternatives for fastening strut upper end 144 to faceguard 128 include integral formation, bonding, non-protrusive fasteners, or forming strut upper end 144 as a clamp for engaging faceguard 128.

Base 142 comprises a rectangular pad-like member having a slight curvature generally corresponding to a curvature of the human chest. Base 142 is attached to the second end or lower end of strut 140, and is generally centered under strut 140. Attachment of base 142 to strut 140 is accomplished either by integral formation, by bonding, or by appropriate fasteners.

The length L of device 100 (e.g., the distance separating the bottom chest-contacting surface of base 142 from faceguard 128) is chosen in order to prevent an undesired degree of anterior flexion. That is, when the wearer is forward-looking the length L of device 100 (see FIG. 6) does not cause base 142 to contact the wearer's chest (or, more precisely, the portion of the wearer's jersey under which shoulder pads 142 are worn). However, when the wearer's head is anteriorly flexed a potentially perilous degree (e.g., 20 degrees), base 142 contacts the wearer's shoulder pads 121, preventing further anterior flexion and also reminding the wearer to extend the neck. This reminder aspect thus also serves as a training aid.

Injury prevention device 100 of FIGS. 5 and 6 can be utilized with or without the device shown in the embodiment of FIG. 1. That is, in one embodiment, device 100 is attached to faceguard 28 of helmet 20 shown in FIG. 1.

Figure 7:
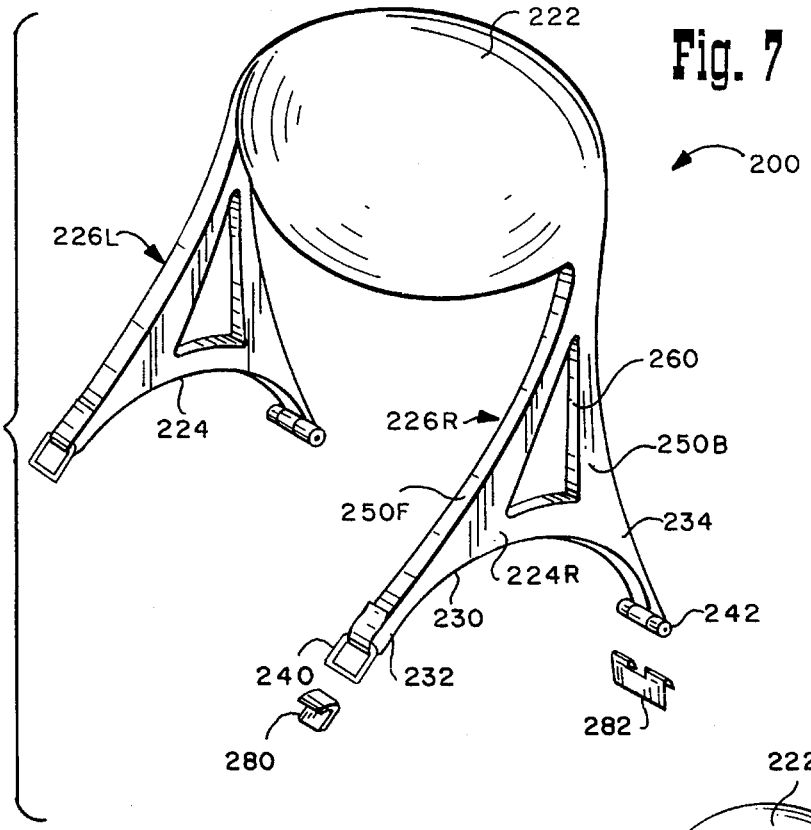
FIG. 7 is a front isometric view of a cervical spine injury prevention device according to a third embodiment of the invention.
Figure 8:
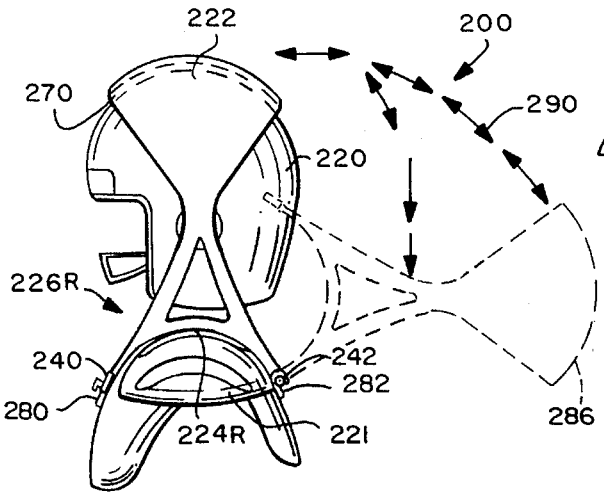
FIG. 8 is a right side view of the device of FIG. 7.
Figure 9:
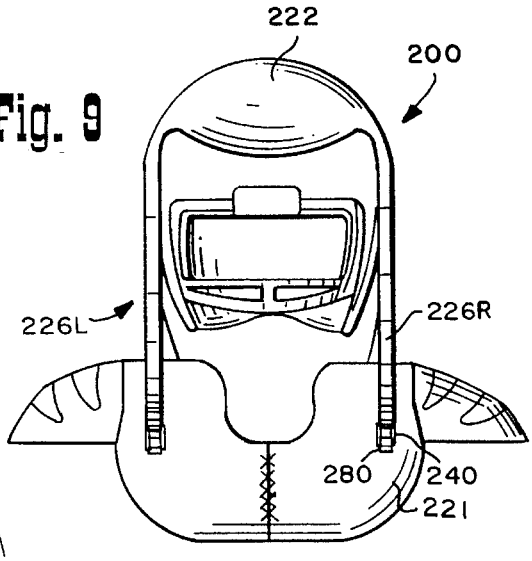
FIG. 9 is a front view of the device of FIG. 7.

FIG. 7, FIG. 8, and FIG. 9 illustrate a cervical spine injury prevention device 200 according to a third embodiment of the invention. The device 200 can be utilized in conjunction with a conventional helmet 220 and shoulder pads 221 (modified with hook and latch attachments as hereinafter described) as illustrated in the drawings, or in conjunction with the device of FIG. 1 and/or device 100.

Protective device 200 comprises a hood portion 222 at its uppermost extent; two shoulder-borne base portions 224L and 224R at its lowermost extent; and, intermediate vertical post portions 226L and 226R. In the illustrated embodiment, hood portion 222, base portions 224, and post portions 226 are integrally formed from a hard plastic.

Base portions 224 have an arcuate undersurface 230 for resting on the tops of shoulder pads 221. Base portions 224 have a front end or foot 232 which terminates on a front side of shoulder pads 221 and a rear end or rear foot 234 which terminates on a rear side of shoulder pads 221. Base front end 232 has a latch 240 mounted thereon. Base rear end 234 has a hinge member 242 mounted thereon. As described below, latch 240 and hinge member 242 are used during installation and removal of protective device 220.

Taken together, a base portion 224 and its adjoining post portion 226 appear to have an essentially arrowhead or triangular shape when seen from a side of the wearer. Each post portion 226 comprises two brace members 250F and 250B (e.g., front brace member 250F and back brace member 250B). Base members 250F and 250B are spaced apart at a farthest distance at their intersection with base portion 224, but converge toward and merge with one another at their top ends at hood portion 222. A triangularly shaped aperture 260 is provided between brace members 250F and 250B.

Hood portion 222 is held aloft just above helmet 220 by post portions 226 resting on shoulder-borne base portions 224. Hood portion 222 has an underside contoured to have substantially the same curvature as the exterior top of helmet 220. Base portions 224 and post portions 216 are sized so that hood portion 222 does not generally contact helmet 220. Rather, a small gap or space 270 is provided between the underside of hood portion 222 and the top outer circumferential surface of helmet 220.

FIG. 7 shows a latch hook 280 which is attachable to or moldable in a front panel of the shoulder pads 221. Latch hook 280 can be sewn or otherwise secured to shoulder pads 221 in a position for engagement by the above-described latch 240. Similarly, FIG. 7 also shows a hinge hook attachment 282 which is likewise attachable to or moldable in a rear panel of the shoulder pads 221. It should be understood that latches 240 and associated latch hooks 280, as well as hinges 242 and associated hinge hooks 282, are provided on both (e.g., right and left) sides of device 200.

FIG. 8 illustrates movement of protective device 220 for installation and removal. In particular, broken lines 286 in FIG. 8 show a removal positional orientation of protective device 200. When latches 240 are unlatched from corresponding latch hooks 280, device 200 can be pivoted rearwardly (in the direction shown by arrows 290 in FIG. 8) about hinges 242. When device 200 is in the removal orientation, the wearer may remove helmet 220.

A fourth device 400 for preventing cervical spine injuries, shown in FIG. 10 and FIG. 11, utilizes a shoulder assembly 401 having leaf springs 406 which, via posts 408, ultimately support a hood 410. In the illustrated embodiment, shoulder assembly 401 is shown as including a pair of shoulder pads 402L, 402R and is of the type worn by football players.

At locations over the wearer's chest, both between the wearer's neck and left shoulder joint on the left body side and between the neck and right shoulder joint on the right body side, shoulder assembly 401 has first ends 404 of the leaf springs 406 connected thereto or integrally formed therewith. From a point at which first ends 404 of leaf springs 406 are attached, leaf springs 406 extend in arcuate manner over a portion of shoulder assembly 401 that extends over the wearer's clavical (see FIG. 10). Leaf springs 406 are thus mounted on shoulder assembly 401 to be essentially transverse to a wearer's clavical. Second ends 405 of leaf springs 406 terminate in cantilevered fashion over the wearer's scapula, at comparable transverse body locations between the neck and shoulder joints as aforementioned with respect to the wearer's chest.

A pair of spring limiting members 420 are mounted on the shoulder assembly 401 to limit movement of second ends 405 of leaf springs 406. In this regard, both a left spring limiting member 420L and a right spring limiting member 420R are shown in FIG. 11. In the illustrated embodiment, spring limiting members 420 have the form of inverted U-shaped brackets through which leaf spring ends 405 extend. Brackets 420 are formed of sufficient size to permit clearance with respect to leaf spring ends 405, so that some predetermined extent of lateral displacement of leaf spring ends 405 is permitted. Brackets 420 are sized to preclude leaf spring second ends 420 from travelling upwardly more than a predetermined displacement from shoulder assembly 401, thereby limiting movement of hood 410 in the event that the wearer sustains an anterior-flexion causing force (in direction of arrow 460).

Each leaf spring 406 has one of the vertically extending posts 408 provided on an intermediate portion of leaf spring 406 intermediate its first and second ends 404, 405, respectively. Post 408 can be integral with leaf spring 406 or otherwise connected thereto.

Hood 410 is connected to the post so that hood 410 is superposed over a helmet 430 worn by the wearer. An interior surface of hood 410 is concavely fashioned to accommodate the curvature of helmet 430. Preferably posts 408 hold hood 410 aloft to allow a small gap between helmet 430 and the interior surface of hood 410.

Figure 14:
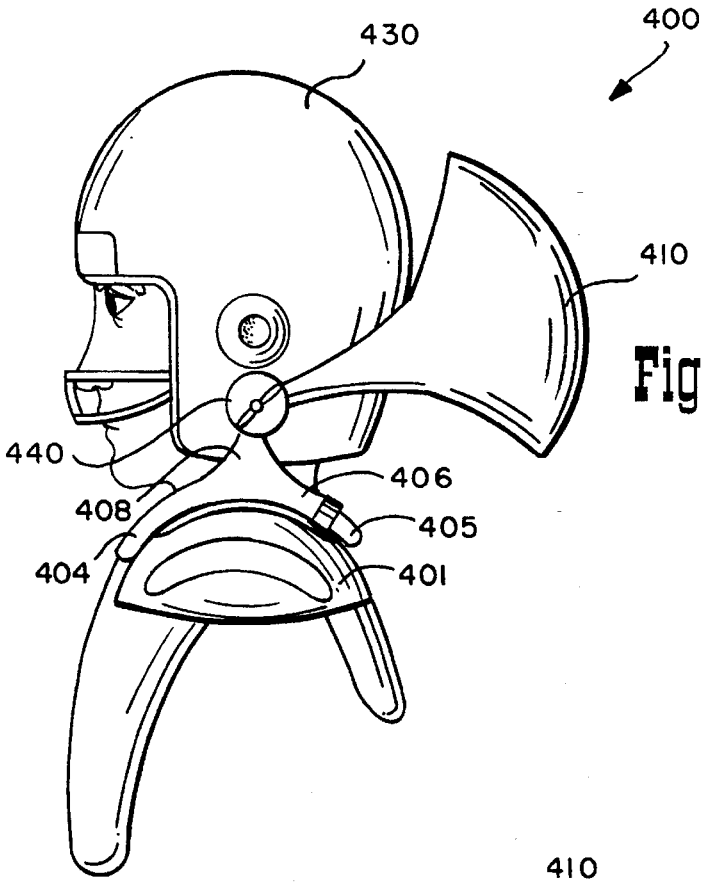
FIG. 14 is a right side view of the device of FIG. 10 in a retracted orientation.

Posts 408 have a locking member 440 provided thereon at a vertical position just below the wearer's ear. As shown in more detail in FIG. 13, locking member 440 selectively pivotally connects post lower segment 408A with upper post segment 408B. Each post segment 408A, 408B terminates with a disk shaped end 441A, 441B, respectively. Disk shaped ends 441A, 441B have ratcheted interior mating surfaces. Locking member 440 comprises wing nut assembly 442 which extends through ratcheted post ends 441A, 441B so as to selectively lock device 400 either into a protection orientation as shown in FIG. 10, a retracted orientation as shown in FIG. 14, or a range of other incremental orientations therebetween. Thus, locking member 440 is provided on post 408 to facilitate selectively rotation of hood 410 about a horizontal axis 450 when locking member 440 is unlocked for permitting the wearer to remove helmet 430. As understood from FIG. 14, in the retracted orientation the wearer can either install or remove helmet 430, since hood 410 is pivoted out of the way.

Figure 15:
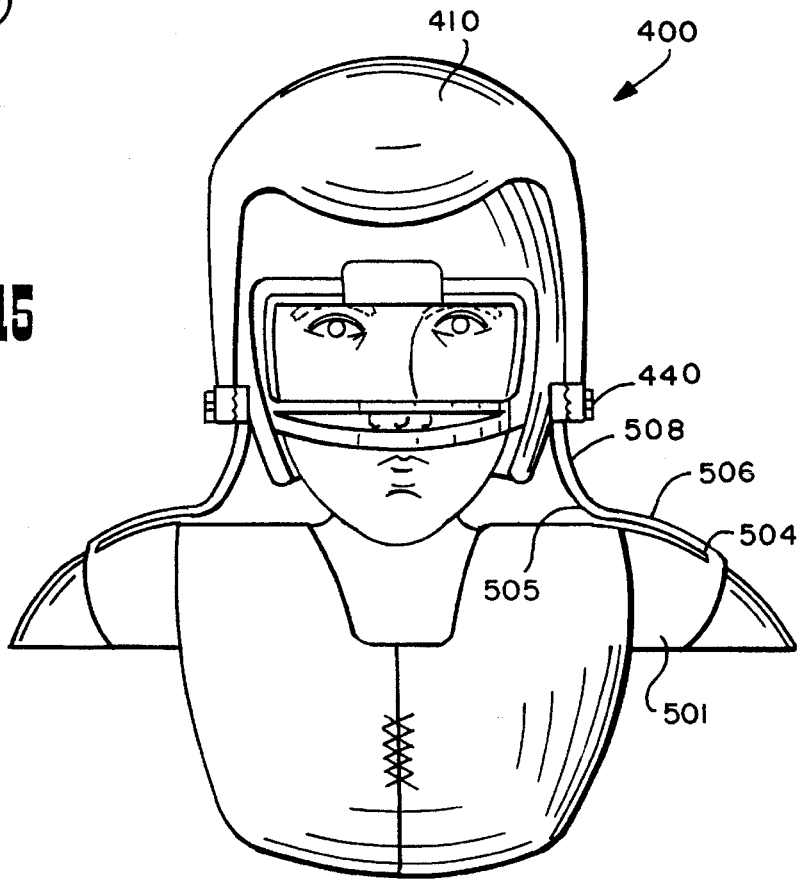
FIG. 15 is a front view of a cervical spine injury prevention device in a protective orientation according to a fifth embodiment of the invention.

FIG. 15 shows a fifth device 500 for preventing cervical spine injuries, with device 500 resembling device 400 of FIG. 10 in most respects excepting positioning of leaf springs 506 on shoulder assembly 501 and the combination of leaf springs 506 with posts 508. Components of device 500 which resemble analogous components of device 400 are provided with similarly numbered reference numerals.

As shown in FIG. 15, leaf springs 506 have first ends 504 positioned essentially directly over the shoulder joints of the wearer. Leaf springs 506 extend over shoulder assembly 501 essentially along a path above the length of the wearer's clavical, with leaf spring 506 being bent almost ninety degrees upwardly at their second ends 505 whereby posts 508 are formed. That is, leaf springs 506 are mounted on shoulder assembly 501 to be essentially parallel to a wearer's clavical. Thus, posts 508 are coterminous with second ends 505 of leaf springs 506 and orthogonal thereto. Posts 508 have locking member 440 formed thereon in like manner with device 400 of the FIG. 10 embodiment.

Devices 400 and 500 both protect the wearer's spine, as axially compressive forces sustained by hood 410 are opposed by posts 408, 508 and shoulder assembly 401, 501.

Although shoulder assemblies 401 and 501 are illustrated herein as being of the types worn by football players, it should be understood, that other forms of shoulder assembly are contemplated herein, such as assemblies otherwise worn over the torso and capable of having leaf springs 406 (or 506), posts 408 and hood 410 connected thereto for absorbing or opposing forces tending to cause cervical axial compression.

In the illustrated embodiment, leaf springs 406 and 506 are fabricated from a material such as steel. However, other materials such as steel-reinforced plastic can be utilized.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. Apparatus for protecting its wearer from cervical spine injuries, the apparatus comprising:

a shoulder assembly;

at least one leaf spring having a first end rigidly connected to the shoulder assembly;

a post formed on the leaf spring;

a hood connected to the post whereby the hood is superposed over a helmet worn by the wearer and whereby axially compressive forces sustained by the hood are opposed by the post and the shoulder assembly.

2. The apparatus of claim 1, wherein the leaf spring has a cantilevered second end, and wherein a spring limiting member is mounted on the shoulder assembly for limiting an extent of movement of the leaf spring.

3. The apparatus of claim 2, wherein the spring limiting member comprises an inverted U-shaped bracket mounted on the shoulder assembly.

4. The apparatus of claim 2, wherein the spring limiting member is mounted on the shoulder assembly for limiting an extent of movement of the second end of the leaf spring.

5. The apparatus of claim 2, wherein the post is formed on a portion of the leaf spring intermediate its first and second ends.

6. The apparatus of claim 1, wherein a locking member is provided on the post to facilitate selectively rotation of the hood about a horizontal axis when the locking member is unlocked for permitting the wearer to remove the helmet.

7. The apparatus of claim 2, wherein the shoulder assembly comprises football shoulder pads.

8. The apparatus of claim 1, wherein the leaf spring is mounted on the shoulder assembly to be essentially transverse to a wearer's clavical.

9. The apparatus of claim 1, wherein the post is coterminous with a second end of the leaf spring and orthogonal thereto.

10. The apparatus of claim 9, wherein the leaf spring is mounted on the shoulder assembly to be essentially parallel to a wearer's clavical.

11. An apparatus for protecting its wearer from cervical spine injuries, the apparatus including:

a helmet, the helmet having a circumferential exterior portion and a neck opening, the helmet further having a flange projecting outwardly from the circumferential exterior portion and spaced above and away from the neck opening;

a helmet support ring mounted above the neck opening, the helmet support ring encircling and in rotating contact about a vertical axis with at least a portion of a circumferential exterior portion of the helmet, the flange on the helmet being positioned so as to engage the helmet support ring and thereby prevent anterior flexion upon application of a force to the helmet; and a stationary frame for mounting the helmet support ring on two shoulders of the wearer whereby the force experienced by the helmet is transmitted by the frame to the two shoulders.

12. The apparatus of claim 11 wherein the helmet support ring has a bearing surface oriented for contact with the circumferential portion of the helmet.

13. The apparatus of claim 11, wherein the frame includes frame struts and a shoulder plate, the frame struts having a first end connected to the helmet support ring and a second end connected to the shoulder plate.

14. The apparatus of claim 13, wherein the second end of the frame struts are connected to the shoulder plate by fasteners.

15. The apparatus of claim 11, wherein the shoulder plate has an essentially quadrilateral shape so that a neck of a user is positioned proximate the center of the quadrilateral.

16. The apparatus of claim 11, further comprising attachment means for attaching the shoulder plate to shoulder pads, and further comprising at least one spacer insert attachable between the shoulder plate and the shoulder pads.

17. The apparatus of claim 16, wherein the shoulder plate is attachable to the shoulder pads by hook and eye fasteners.

18. The apparatus of claim 16, wherein the spacer insert is attachable to one of the shoulder pads and the shoulder plate by hook and eye fasteners.

19. The apparatus of claim 16, wherein the shoulder plate is attachable to the shoulder pads by hook and eye fasteners.

20. An apparatus for use in conjunction with a helmet having a neck opening, the apparatus protecting its wearer from cervical spine injuries, the apparatus including:

a flange for outwardly projecting attachment to a circumferential exterior portion of the helmet;

a helmet support ring mounted above the neck opening, the helmet support ring encircling and for rotating contact with at least a portion of the circumferential exterior portion of the helmet;

the flange being attachable to the circumferential exterior portion of a helmet so as to be engagable by the helmet support ring and prevent anterior flexion when a force is applied to the helmet; and a stationary frame for mounting the helmet support ring on two shoulders of its wearer whereby force experienced by the helmet is transmitted by the frame to the two shoulders.

21. The apparatus of claim 20, wherein the helmet support ring has a bearing surface oriented for contact with the circumferential portion of the helmet.

22. The apparatus of claim 20, wherein the frame includes frame struts and a shoulder plate, the frame struts having a first end connected to the helmet support ring and a second end connected to the shoulder plate.

23. The apparatus of claim 20, wherein the shoulder plate has an essentially quadrilateral shape so that a neck of a user is positioned proximate the center of the quadrilateral.

24. The apparatus of claim 20, wherein the shoulder plate is attachable to shoulder pads, and further comprising at least one spacer insert attachable between the shoulder plate and the shoulder pads.

25. An apparatus for use in conjunction with a helmet for protecting its wearer from cervical spine injuries, the apparatus comprising:

two base members configured to be attachably borne by a wearer's shoulders, a first of the base members being borne by a left shoulder and a second of the base members being borne by a right shoulder;

a hood having an underside surface of curvature substantially similar to a curvature of the helmet worn by the wearer; and, two post members for holding the underside surface of the hood aloft above the helmet by a predetermined distance, a first post member having a lower end attached to the first of the base members and a second post member having a lower end attached to the second of the base members, tops of each post member having the hood mounted thereon.

26. The apparatus of claim 25, wherein at least one end the base members are hingedly attached to shoulder pads worn by the wearer.

27. The apparatus of claim 25, wherein at least one end the base members are releasably attached to shoulder pads worn by the wearer.

28. The apparatus of claim 25, wherein the two base members, hood and two post members are integrally formed.

29. The apparatus of claim 25, wherein a first of the base members and a first of the post members collectively have an arrowhead or triangular shape.

30. The apparatus of claim 25, wherein each post member has two brace members spaced apart at a base thereof, the two brace members converging toward top ends thereof.

31. The apparatus of claim 30, wherein a triangularly shaped aperture is formed between the two brace members.

32. The apparatus of claim 11, wherein the flange is located at a first distance above the neck opening and the helmet support ring is mounted at a second distance above the neck opening, and wherein the second distance is greater than the first distance.

33. The apparatus of claim 11, wherein the flange is a posterior flange.

34. The apparatus of claim 20, wherein the flange is a posterior flange.

* * * * *